US011479395B2

(12) United States Patent
Vasileiadis et al.

(10) Patent No.: US 11,479,395 B2
(45) Date of Patent: Oct. 25, 2022

(54) PACKAGING DEVICE AND METHOD

(71) Applicant: BIC VIOLEX S.A, Anoixi (GR)

(72) Inventors: Andreas Vasileiadis, Anoixi (GR); Dionysios Klavdianos, Anoixi (GR)

(73) Assignee: BIC VIOLEX Single Member S.A., Anoixi (GR)

( * ) Notice: Subject to any disclaimer, the term of this patent is extended or adjusted under 35 U.S.C. 154(b) by 0 days.

(21) Appl. No.: 17/083,614

(22) Filed: Oct. 29, 2020

(65) Prior Publication Data

US 2021/0163200 A1 Jun. 3, 2021

(51) Int. Cl.
*B65D 75/14* (2006.01)
*B65D 75/58* (2006.01)

(52) U.S. Cl.
CPC ..... *B65D 75/14* (2013.01); *B65D 75/5805* (2013.01)

(58) Field of Classification Search
CPC ..... B65D 75/14; B65D 75/5805
USPC ..... 206/472, 784, 486, 489, 351, 585, 588, 206/589, 590; 229/87.03, 103
See application file for complete search history.

(56) References Cited

U.S. PATENT DOCUMENTS 2,959,340 A * 11/1960 Hennessey ..... B65D 5/5019 206/592
3,239,177 A 3/1966 Samsing
3,332,542 A 7/1967 Samsing
3,410,476 A * 11/1968 Buttery ..... B65D 5/5415 229/207
3,567,103 A 3/1971 Seifert
3,927,767 A 12/1975 Sato et al.
3,981,434 A * 9/1976 Ramich ..... B65D 5/5415 229/125.05
4,239,115 A * 12/1980 Froom ..... B65D 5/5435 229/227
4,838,432 A * 6/1989 DePaul ..... B65D 5/5435 229/905
4,919,271 A * 4/1990 Kuchenbecker ..... B65D 5/541 229/237
5,121,838 A * 6/1992 Dickie ..... B65D 5/5021 206/707

(Continued)

FOREIGN PATENT DOCUMENTS

EP 1174350 A1 1/2002
GB 2434982 A 8/2007

(Continued)

OTHER PUBLICATIONS

Pinterest, Crusoe Treasure Wines, retrieved from the internet at https://www.pinterest.com/pin/338473728221835501/an Oct. 23, 2020, 1 page.

(Continued)

*Primary Examiner* — Jacob K Ackun
(74) *Attorney, Agent, or Firm* — Bookoff McAndrews, PLLC.

(57) ABSTRACT

A packaging for a product comprising a container including a first body layer and a second body layer connected at a fold, the first and second body layers capable of collapsing to a first position and expanding to a second position, and one or more of said first and second body layers defining a void, and a cover including a first side and a second side, and the first and second body layers are configured to collapse to the first position between the first and second sides of the cover.

19 Claims, 8 Drawing Sheets

(56) References Cited

U.S. PATENT DOCUMENTS

| | | | | |
|---|---|---|---|---|
| 5,295,580 | A * | 3/1994 | Hicks | B65D 5/5054 229/87.02 |
| 5,454,180 | A | 10/1995 | Volpe | |
| 5,862,816 | A | 1/1999 | Lowe | |
| 6,227,444 | B1 * | 5/2001 | Makoesky | B65D 27/34 229/928 |
| 6,520,328 | B2 | 2/2003 | Ortiz | |
| 7,070,048 | B2 * | 7/2006 | Gelardi | G11B 33/0444 |
| 8,292,095 | B2 | 10/2012 | Howlett | |
| 2005/0218033 | A1 | 10/2005 | Curtis | |
| 2007/0062050 | A1 | 3/2007 | Worrick, III | |
| 2015/0344216 | A1 * | 12/2015 | Petty | B65D 5/6626 206/589 |
| 2016/0325875 | A1 | 11/2016 | Lee et al. | |

FOREIGN PATENT DOCUMENTS

| | | | |
|---|---|---|---|
| NL | 9201375 | A | 2/1994 |
| WO | 2010007410 | A1 | 1/2010 |

OTHER PUBLICATIONS

Omar Ibrahim, Gillette Razor Packaging, retrieved from the internet at https://cargocollective.com/omar_ibrahim/Gillette-Razor-Packaging on Oct. 23, 2020, 5 pages.

59mm7f Shave Stand, Reddit, posted by ChunksOWisdom on Oct. 27, 2016, retrieved from the internet at https://www.reddit.com/r/wicked_edge/comments/59mm7f/shave_stand_i_made_with_the_box_my_maggard/ on Oct. 23, 2020.

Extended European search report issued in European Patent Application No. 19212509.4, dated Jun. 30, 2020.

* cited by examiner

PACKAGING DEVICE AND METHOD

CROSS-REFERENCE TO RELATED APPLICATION(S)

This application claims benefit from European patent application EP19212509.4 filed on Nov. 29, 2019, its content being incorporated herein by reference.

FIELD

The present disclosure relates generally to the field of packaging, and in particular a packaging device for a product to be shipped. More specifically, the present disclosure relates to a packaging device for shipment of a handheld shaving device.

BACKGROUND ART

With the growth of eCommerce within the consumer marketplace, there is an increased need for effective and environmentally friendly packaging for shipment of products. At any stage of the shipping process, the contents of a package may become exposed to physical damage caused by factors such as vibration and turbulent movement, pressure exerted on the package, impact sustained by the package, and/or general mishandling. For a packaging to be effective, the packaging should secure the positioning and integrity of contents within the package and withstand pressure and impact on the package. Moreover, the packaging should be easy to open for the consumer and/or effectively display information that may be useful to the consumer. For a packaging to be environmentally friendly, the packaging should be conscious of factors such as recyclability, reducing the usage of excess materials, and a capability for reuse.

Currently available packaging devices and methods usually employ industrially prefabricated boxes in conjunction with other packaging components such as plastic blisters, plastic bubble wrap, polystyrene foam frames and packing peanuts, and paper stuffing. These currently available packaging devices and methods lack rigidity to withstand deformation of the packaging, do not secure the positioning of the contents of the package, do not withstand pressure and impact on the package, make use of materials which are harmful to the environment, and cause frustration to a consumer by being difficult to open and lacking information desired by the consumer.

It is desirable to provide an improved packaging in a manner that fulfills one or more of the needs described above.

SUMMARY

According to aspects of the present disclosure, a packaging (hereafter, "the packaging") comprises a container and a cover, the container of the packaging includes a first body layer and a second body layer connected at a fold, the first and second body layers are capable of collapsing to a first position and expanding to a second position, one or more of the first and second body layers defines a void, the cover of the packaging includes a first side and a second side, and the first and second body layers are configured to collapse to the first position between the first and second sides of the cover. The cover includes a sidewall and the first and second sides are connected to the sidewall at respective folds. The container and the cover are constructed as one sheet.

According to aspects of the present disclosure, the cover may include a package opening mechanism.

According to aspects of the present disclosure, the container may include one or more inner body layers between the first and second body layers and the first body layer, second body layer, and one or more inner body layers may be connected at respective folds.

According to aspects of the present disclosure, each of the body layers may comprise a void having a contour and together the voids form a cavity in the first position.

According to aspects of the present disclosure, one or more of the contours may have different dimensions.

According to aspects of the present disclosure, the second side of the cover may be connected to a body layer at a fold.

According to aspects of the present disclosure, the cover may include one or more extensions capable of mating with one or more body layers.

According to aspects of the present disclosure, the cover may face the body layers when the body layers are in the first position.

According to aspects of the present disclosure, the body layers may be configured in a stacked arrangement in the first position.

According to aspects of the present disclosure, the cover may include a pre-cut section configured to be removed and removal of the pre-cut section may define a channel in the cover. Reinsertion of the pre-cut section into the channel may support the cover in an upright position.

According to aspects of the present disclosure, a method of making a packaging for a product is provided. The method comprises a step of connecting a first body layer to a second body layer at a fold to form a container, the first and second body layers are capable of collapsing to a first position and expanding to a second position, one or more of the first and second body layers defines a void, a step of providing a cover including a first side and a second side, and a step of collapsing the first and second body layers to the first position between the first and second sides of the cover.

According to aspects of the present disclosure, the method may further comprise a step of connecting the container to the first side of the cover or the second side of the cover at a fold.

According to aspects of the present disclosure, the method step of connecting a first body layer to a second body layer at a fold may include connecting a third body layer to the second body layer at a fold.

According to aspects of the present disclosure, a method of making a holder for a product out of a packaging is provided. The method comprises a step of providing a packaging having a first side, a second side, and a pre-cut section extending through the first side and the second sides, a step of removing the pre-cut section from the packaging to define a channel, a step of folding the first side toward the second side, and a step of reinserting the pre-cut section into the channel to support the packaging in an upright position.

According to aspects of the present disclosure, the method step of providing a packaging may include the pre-cut section having a hook configured to extend through the channel and anchor against exterior surfaces of the first and second sides and a support extending from the hook configured to support the hook within the channel.

According to aspects of the present disclosure, the method step of providing a packaging may include the pre-cut section having further pre-cuts along one or more inner portions configured to be removed to receive the product.

In the manner described and according to aspects illustrated herein, the packaging may be configured to address one or more needs such as improving the positioning and integrity of the product while packaged, improving durability, and reducing the usage of environmentally harmful materials and/or excess materials.

BRIEF DESCRIPTION OF THE DRAWINGS

Aspects of an embodiment will be described in reference to the drawings, where like numerals reflect like elements.

DETAILED DESCRIPTION

Figure 1:
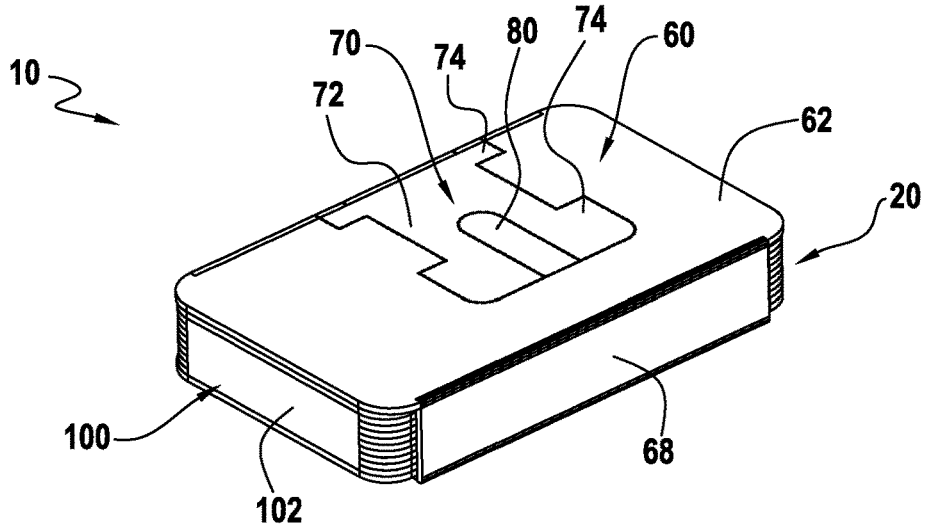
FIG. 1 is a top perspective view of the packaging according to aspects of the disclosure.

An embodiment of the packaging according to aspects of the disclosure will now be described with reference to FIGS. 1-12, wherein like numerals represent like parts, and will generally be referred to by the reference numeral 10. Although the packaging 10 is described with reference to specific examples, it should be understood that modifications and changes may be made to these examples without going beyond the general scope as defined by the claims. In particular, individual characteristics of the various embodiments shown and/or mentioned herein may be combined in additional embodiments. Consequently, the description and the drawings should be considered in a sense that is illustrative rather than restrictive. The Figures, which are not necessarily to scale, depict illustrative aspects and are not intended to limit the scope of the disclosure. The illustrative aspects depicted are intended only as exemplary.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

Various materials, methods of construction and methods of fastening will be discussed in the context of the disclosed embodiment(s). Those skilled in the art will recognize known substitutes for the materials, construction methods, and fastening methods, all of which are contemplated as compatible with the disclosed embodiment(s) and are intended to be encompassed by the appended claims.

As used in this disclosure and the appended claims, the singular forms "a," "an," and "the" include plural referents unless the content clearly dictates otherwise. As used in this disclosure and the appended claims, the term "or" is generally employed in its sense including "and/or" unless the content clearly dictates otherwise.

Throughout the description, including the claims, the terms "comprising a," "including a," and "having a" should be understood as being synonymous with "comprising one or more," "including one or more," and "having one or more" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially," "approximately," and "generally" should be understood to mean falling within such accepted tolerances.

When an element or feature is referred to herein as being "on," "engaged to," "connected to," or "coupled to" another element or feature, it may be directly on, engaged, connected, or coupled to the other element or feature, or intervening elements or features may be present. In contrast, when an element or feature is referred to as being "directly on," "directly engaged to," "directly connected to," or "directly coupled to" another element or feature, there may be no intervening elements or features present. Other words used to describe the relationship between elements or features should be interpreted in a like fashion (e.g., "between" versus "directly between," "adjacent" versus "directly adjacent," etc.).

Spatially relative terms, such as "top," "bottom," "middle," "inner," "outer," "beneath," "below," "lower," "above," "upper," and the like, may be used herein for ease of description to describe one element or feature's relationship to another element(s) or feature(s) as illustrated in the drawings. Spatially relative terms may be intended to encompass different orientations of a device in use or operation in addition to the orientation depicted in the drawings. For example, if the device in the drawings is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms "first," "second," etc. may be used herein to describe various elements, components, regions, layers, sections, and/or parameters, these elements, components, regions, layers, sections, and/or parameters should not be limited by these terms. These terms are only used to distinguish one element, component, region, layer, or section from another region, layer, or section. Thus, a first element, component, region, layer, or section discussed herein could be termed a second element, component, region, layer, or section without departing from the teachings of the present inventive subject matter.

As shown in FIGS. 1-5, the packaging 10 may be contemplated for use with a product 200, such as a handheld shaving device and additional shaving device heads. The packaging may comprise a container 20, a cover 60, a securing extension 100, and a package opening mechanism 120. The container 20, cover 60, securing extension 100, and package opening mechanism 120 may all be constructed from and/or as one sheet of die-cut material and connected by folds 12 (see FIG. 8) to reduce the usage of environmentally harmful materials and/or excess materials. In the disclosed embodiment, the material may be corrugated cardboard, however, a person having ordinary skill in the art would understand that other materials, such as fiber, foil, cloth, paper, corrugated fiberboard, chipboard, paperboard, plastic, rubber, foam, and metal may be compatible with the packaging 10. To allow for ease of folding, the material at each fold 12 of the packaging 10 may be creased, perforated or pre-cut, thinner, and/or less robust than the material used for the remaining elements of the packaging 10.

Referring to FIGS. 5-8, the container 20 may include a plurality of body layers 24*a*, 24*b*, 24*c* which are each connected at a fold 12 in a pleated relationship. It is also contemplated that the container 20 may include a first body layer 24*a* connected to the cover 60 at a fold 12 and a second body layer 24*b* connected to the first body layer 24*a* at a fold 12. Referring to the embodiment shown in FIG. 5, the body layers 24*a*, 24*b*, 24*c* may include a bottom outer body layer (first body layer) 24*a*, a top outer body layer (second body layer) 24*b*, and one or more inner body layers (third body layers) 24*c*. In the disclosed embodiment, there may be a series of 1-20 inner body layers 24*c*, however the embodiment depicted in FIG. 5 includes a series of 7 inner body layers 24*c*. The bottom outer body layer 24*a* may connect to one inner body layer 24*c* and the cover 60 at opposing folds 12. The top outer body layer 24*b* may connect to the one inner body layer 24*c* at a fold 12. Depending on the position of the inner body layer 24*c* and/or the amount of inner body layers 24*c*, each inner body layer 24*c* may connect to two other inner body layers 24*c* at opposing folds 12, to one other inner body layer 24*c* and the bottom or top outer body layers 24*a*, 24*b* at opposing folds 12, or to the bottom and top outer body layers 24*a*, 24*b* at opposing folds 12. The body layers 24*a*, 24*b*, 24*c* may be substantially flat and configured to collapse to a first position (see FIG. 4) wherein the body layers 24*a*, 24*b*, 24*c* are folded at each fold 12 and stacked in an aligned surface-to-surface arrangement. The body layers 24*a*, 24*b*, 24*c* may expand to a second position (see FIGS. 5-8) wherein the body layers 24*a*, 24*b*, 24*c* are extended outwardly from the cover 60 and/or are no longer folded and stacked in an aligned surface-to-surface arrangement. Each of the body layers 24*a*, 24*b*, 24*c* may include one or more voids 26. Together, in the first position, the voids 26 may define a cavity 27 for receiving the product 200. Each of the voids 26 may have a contour which corresponds to a specific cross-section of the product 200 to improve the positioning and integrity of the product 200 in the container 20 (see FIG. 12). The contour of each void 26 may have varying dimensions from one body layer 24*a*, 24*b*, 24*c* to an adjacent preceding and/or succeeding body layer 24*a*, 24*b*, 24*c* depending on the corresponding dimensions of a contour of the cross-section of the product 200 at a specific height of the product 200 (see FIGS. 4 and 7-9). A varying of the "dimensions" as referred to herein should be understood to encompass a differing or changing of the size, shape, geometry, and/or relative position of the contour of each void 26. Each contour of each void 26 may include a portion 28 that flares outwardly from the contour of the product 200 for accommodating a finger of a user to facilitate removal of the product 200 from the container 20. Each of the body layers 24*a*, 24*b*, 24*c* may define a recess 30 at opposing ends. Together, the recesses 30 form a securing port 32 (see FIG. 4) for mating with the securing extension 100 and thereby aligning the body layers 24*a*, 24*b*, 24*c* and the voids 26 as well as improving durability of the packaging 10. The securing port 32 may include a hanging element 33 (see FIG. 2). The hanging element 33 may be a pre-cut formation which includes an extension 34 having an opening 35 for hanging the packaging 10 on an organizational structure (not shown). The opening 35 may have any suitable shape, such as a circle or a butterfly-shape, for hanging on the organizational structure.

As shown in FIGS. 2-5, the cover 60 may include a top (first) side 62, a bottom (second) side 64, a first sidewall 66 linking the top and bottom sides 62, 64, and a second sidewall 68 linking the top side 62 to the package opening mechanism 120. It is also contemplated that the package opening mechanism 120 may be positioned on the top or bottom sides 62, 64 of the cover 60. The top side 62 of the cover 60 may connect to the first and second sidewalls 66, 68 at opposing folds 12 and the bottom side 64 of the cover 60 may connect to the first sidewall 66 and the bottom outer body layer 24*a* at opposing folds 12. In the disclosed embodiment, there may be a pair of securing extensions 100. At opposing ends of the cover 60, each securing extension 100 may include a lower (first) section 102 connecting to the bottom side 64 of the cover 60 at a fold 12 and an upper (second) section 104 connecting to the lower section 102 at a fold 12. The lower section 102 may be configured to be received by the recesses 30 defined by the body layers 24*a*, 24*b*, 24*c* in a press-fit arrangement, however, a person having ordinary skill in the art would understand that other mating arrangements may be compatible with the packaging.

Figure 4:
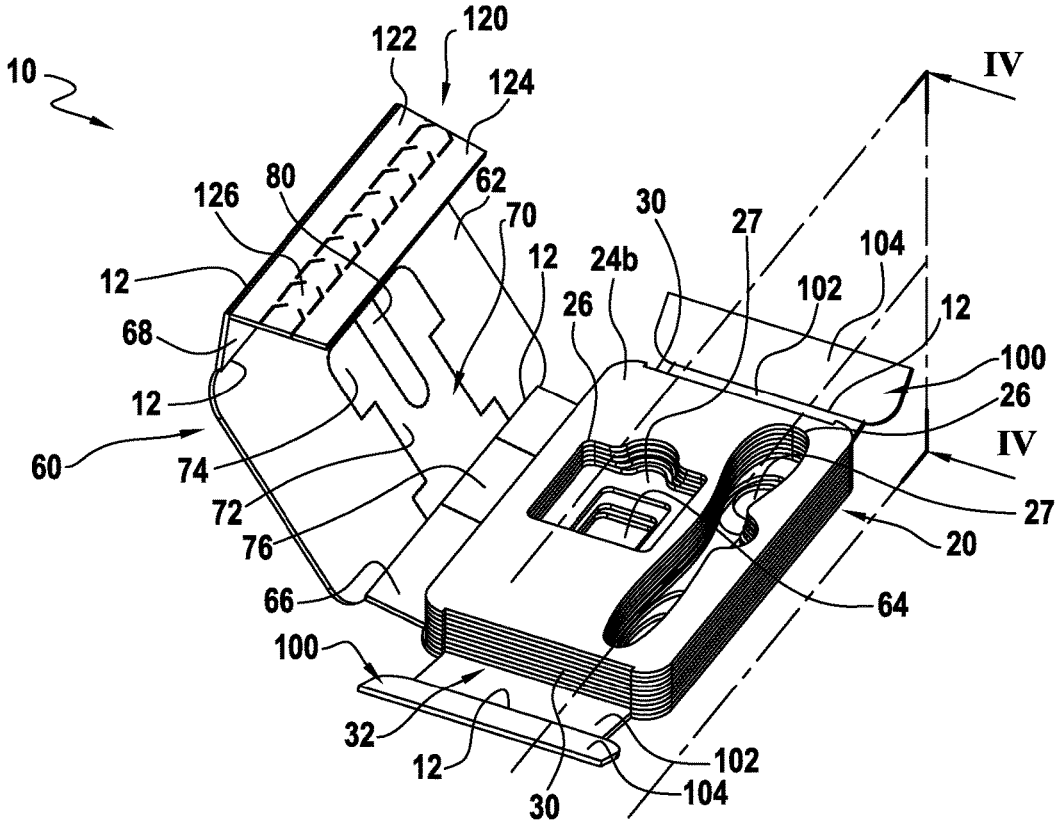
FIG. 4 is a top perspective view of the packaging of FIG. 1, illustrating a container of the packaging in a first position.
Figure 5:
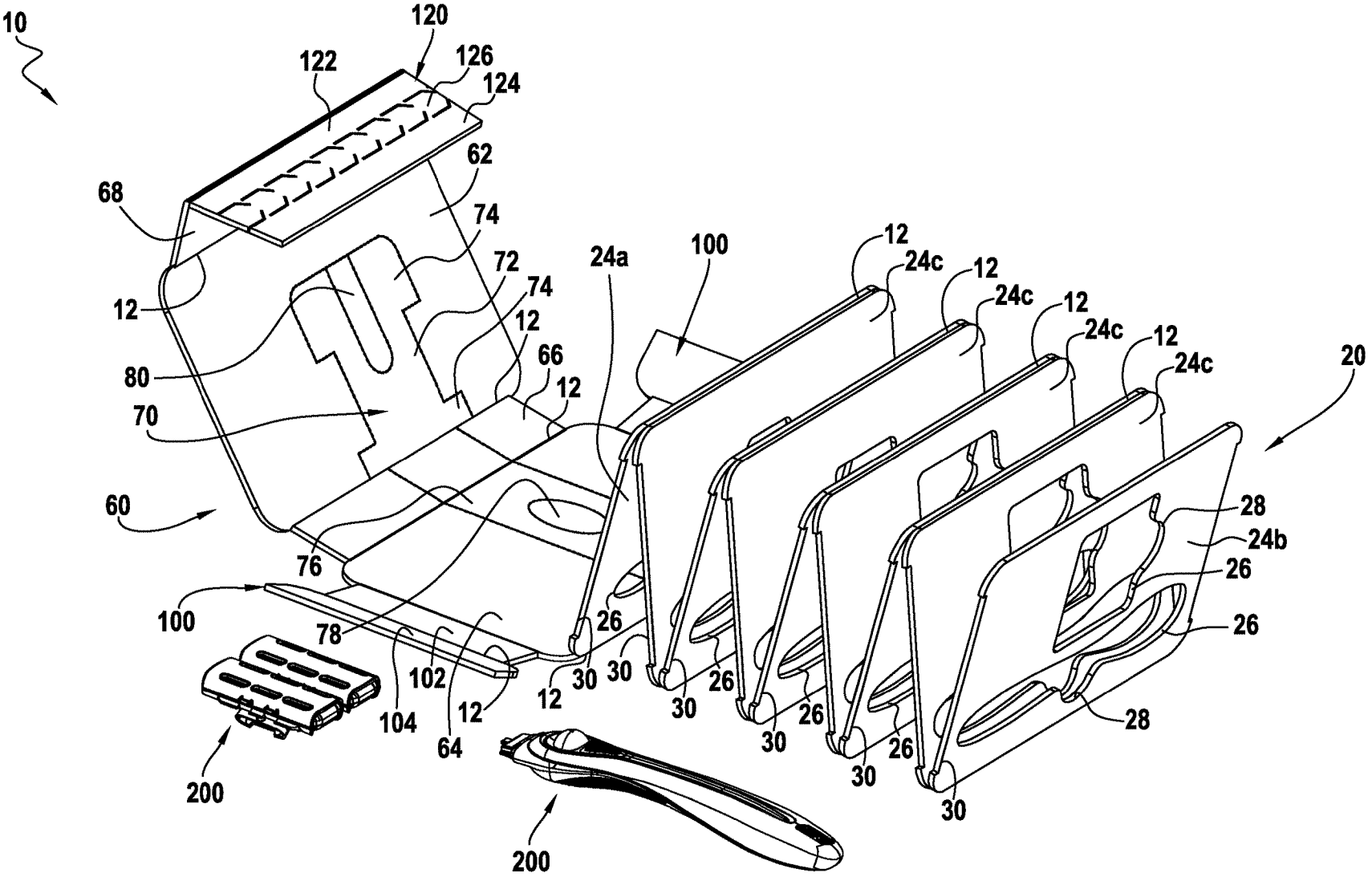
FIG. 5 is a top perspective view of the packaging of FIG. 1, illustrating the container of the packaging in a second position.
Figure 6:
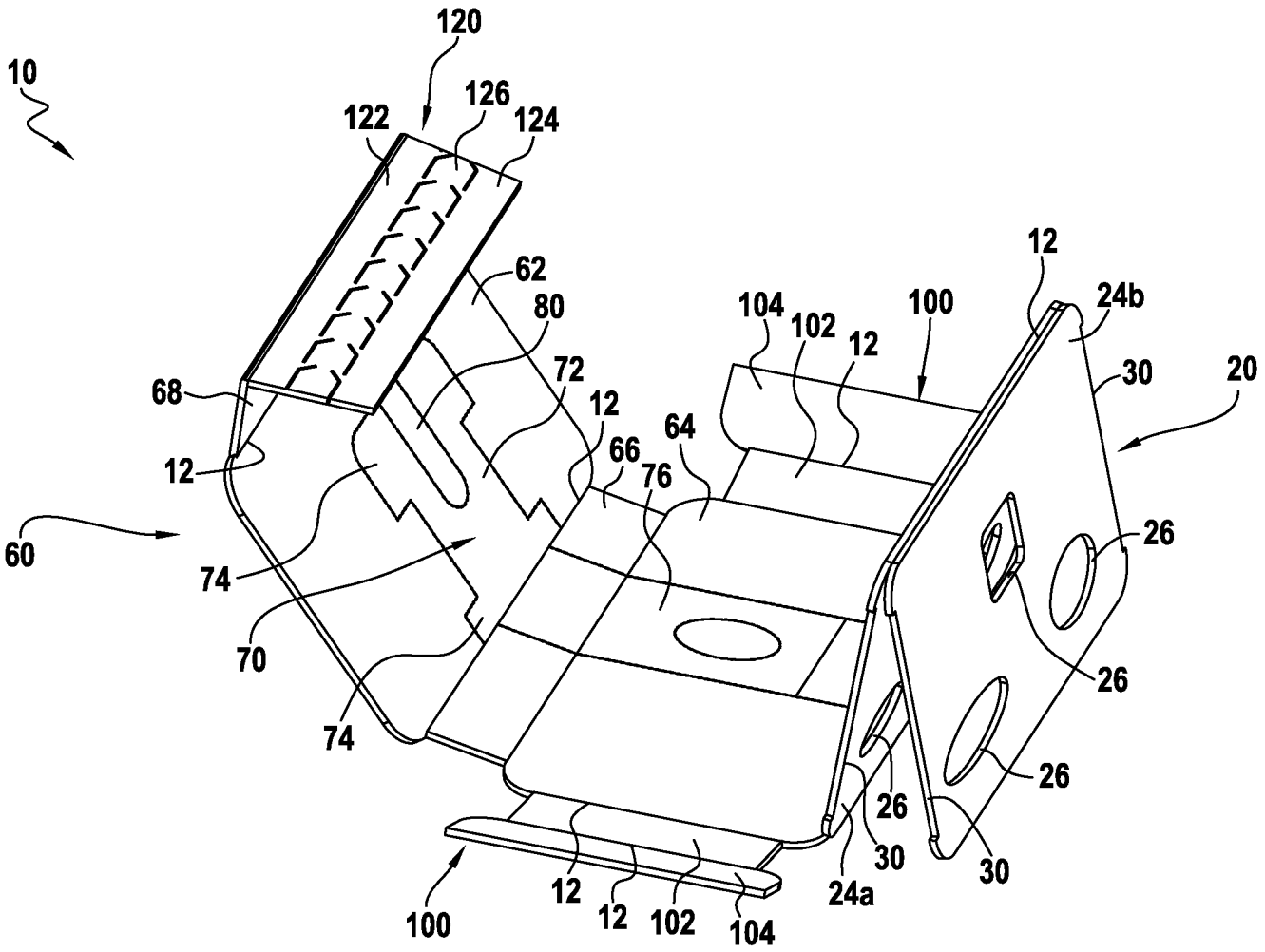
FIG. 6 is a top perspective view of an alternative embodiment of the packaging of FIG. 1, illustrating the container of the packaging between the first position and the second position.
Figure 7:
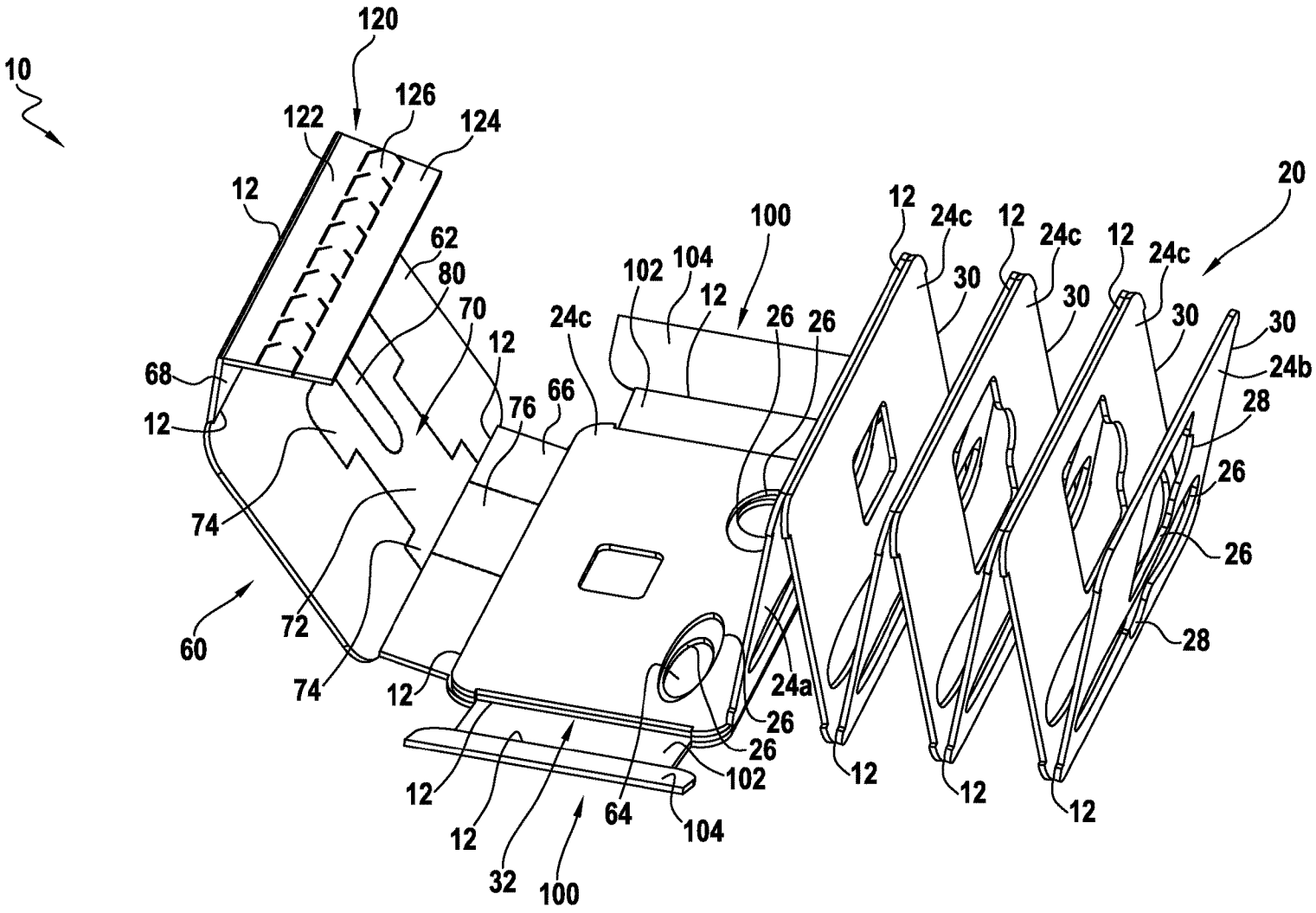
FIG. 7 is a top perspective view of the packaging of FIG. 1, illustrating the container of the packaging transitioning between the first position and the second position.
Figure 8:
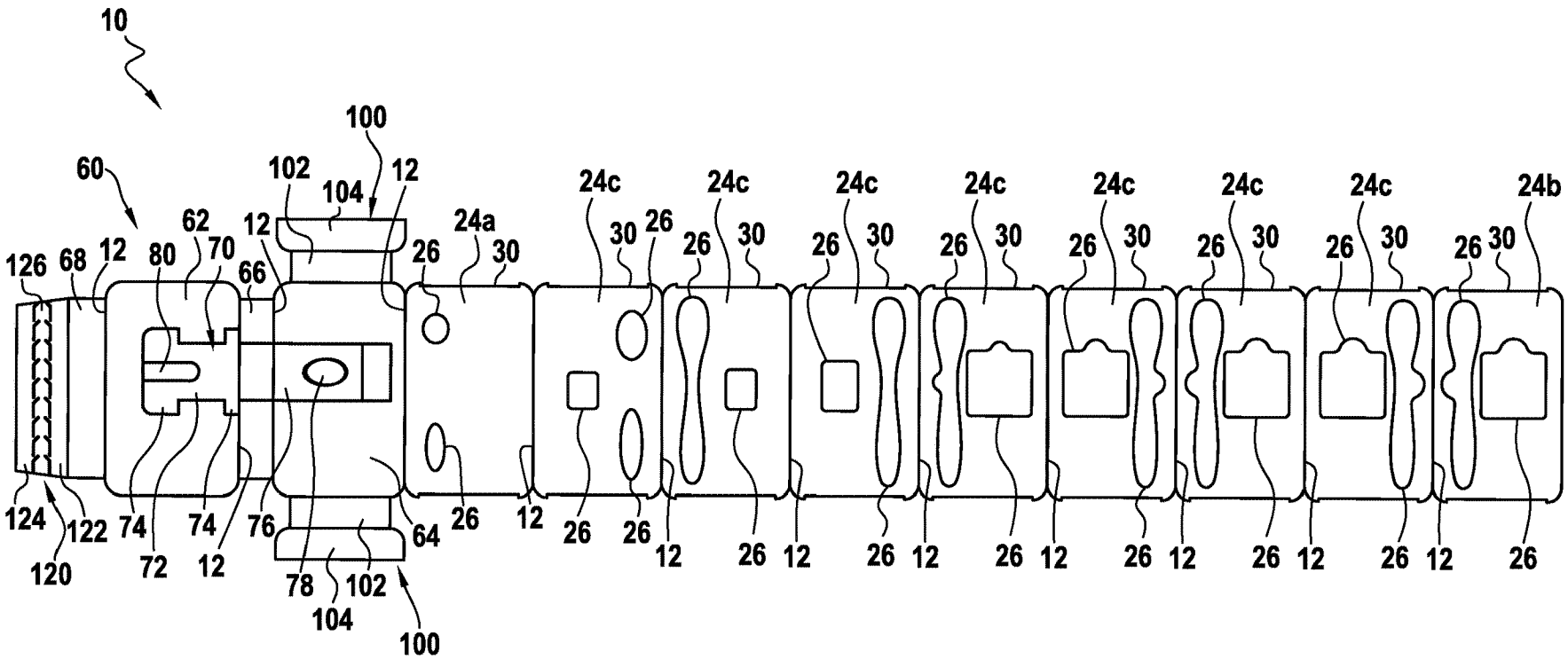
FIG. 8 is a top view of the packaging of FIG. 1, illustrating the container of the packaging in the second position.
Figure 9:
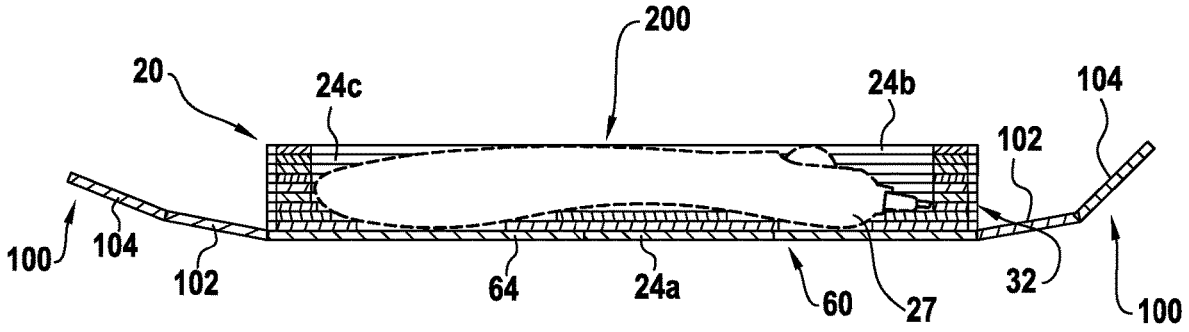
FIG. 9 is a side cross-sectional view of the packaging of FIG. 1, taken along the line IX shown in FIG. 4.

As illustrated by FIGS. 4-5 and 7, when collapsing the container 20 to the first position, the bottom outer body layer 24*a* may fold inwardly and collapse toward the bottom side 64 of the cover 60 at the fold 12 connecting the bottom outer body layer 24*a* to the bottom side 64 of the cover 60 and lay against the bottom side 64 of the cover 60 in a surface-to-surface relationship. A succeeding inner body layer 24*c* connected at the opposite fold 12 of the bottom outer body layer 24*a* may fold inwardly and collapse toward the bottom side 64 of the cover 60 at the fold 12 connecting the succeeding inner body layer 24*c* to the bottom outer body layer 24*a* and lay against the bottom outer body layer 24*a* in a surface-to-surface relationship (see FIG. 7). In this manner, each successive inner body layer 24*c* may fold inwardly and collapse toward the bottom side 64 of the cover 60 at the fold 12 connecting the successive inner body layers 24*c* with the preceding inner body layers 24*c* and lay against the preceding inner body layers 24*c* in a surface-to-surface relationship. Finally, the top outer body layer 24*b* may fold inwardly and collapse toward the bottom side 64 of the cover 60 at the fold 12 connecting the top outer body layer 24*b* to the preceding inner body layer 24*c* and lay against the preceding inner body layer 24*c* in a surface-to-surface relationship. In this arrangement, the body layers 24*a*, 24*b*, 24*c* may all fold and collapse into a stack of body layers 24*a*, 24*b*, 24*c* supported by the bottom side of the cover 64 (see FIG. 4) to reduce damage to the packaging 10 caused by impact and pressure exerted on the packaging 10, increase durability of the packaging 10, and improve and maintain positioning of the product 200 to ensure that after transportation, shipment, Point of Sale, and un-packaging the consumer will receive the product 200 in a manner intended by a seller.

Referring to FIGS. 1 and 4, once the body layers 24*a*, 24*b*, 24*c* are folded and stacked on the bottom side of the cover 64, the lower section 102 of each securing extension 100 may fold inwardly toward the body layers 24*a*, 24*b*, 24*c* at the fold 12 connecting the lower section 102 of each securing extension 100 to the bottom side 64 of the cover 60. The lower section 102 of each securing extension 100 may fold into and mate with each recess 30 (the securing port 32) defined at the corresponding end of each body layer 24*a*, 24*b*, 24*c*. The upper section 104 of each securing extension 100 may fold at the fold 12 connecting the upper section 104 of each securing extension 100 to the lower section 102 of each securing extension 100. The upper section 104 may fold over the top outer body layer 24*b* and lay against the top outer body layer 24*b* in a surface-to-surface relationship. The top side 62 of the cover 60 may fold towards the body layers 24*a*, 24*b*, 24*c* at the fold 12 connecting the top side 62 of the cover 60 to the first sidewall 66. The first sidewall 66 may lay against edges of the body layers 24*a*, 24*b*, 24*c* and the top side 62 of the cover 60 may lay against the upper section 104 of the securing extensions 100 and/or the top outer body layer 24*b* in a surface-to-surface relationship. The second sidewall 68 may then fold over the top outer body layer 24*b* at the fold 12 connecting the second sidewall 68 to the top side 62 of the cover 60 and lay against edges of the body layers 24*a*, 24*b*, 24*c*.

Figure 2:
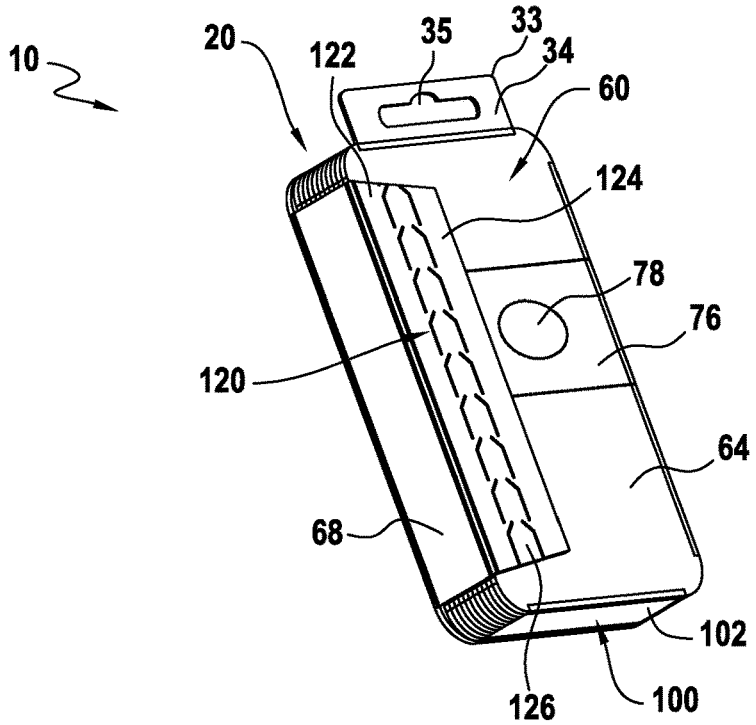
FIG. 2 is a bottom perspective view of the packaging of FIG. 1.
Figure 3:
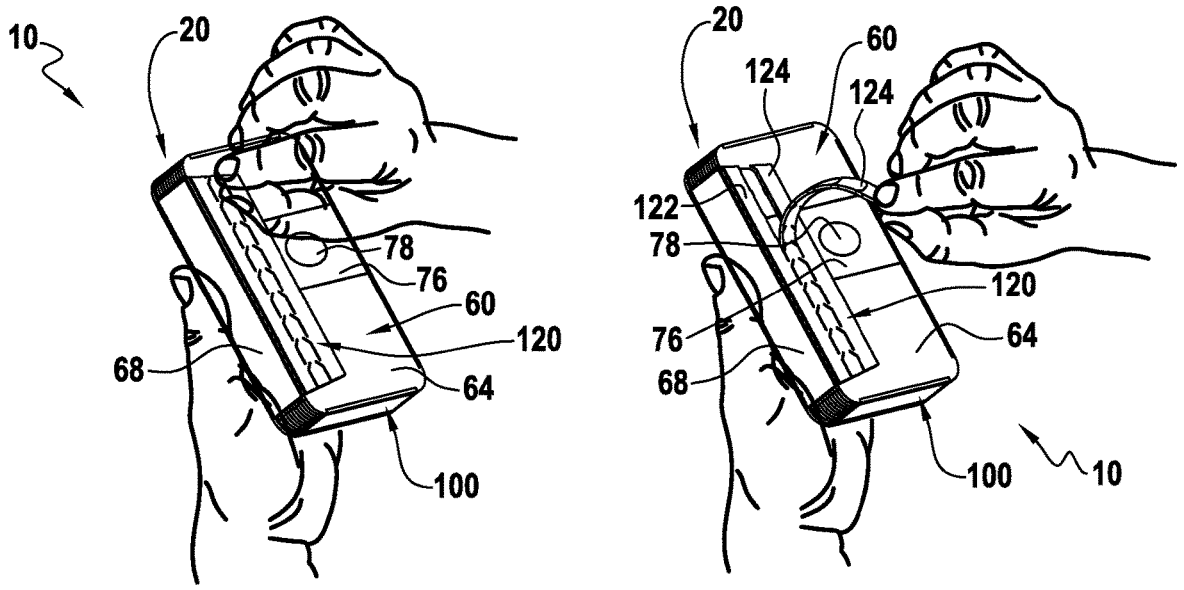
FIG. 3 is a bottom perspective view of the packaging of FIG. 1, illustrating the packaging being opened by a user.

As shown in FIGS. 2 and 3, the package opening mechanism 120 may comprise an extension 122 which folds over the bottom side 64 of the cover 60 at the fold 12 connecting the package opening mechanism 120 to the second sidewall 68 and lay against an exterior surface of the bottom side 64 of the cover 60 in a surface-to-surface relationship. The package opening mechanism 120 may include a fastening portion 124 that affixes to the bottom side 64 of the cover 60. In the disclosed embodiment, the package opening mechanism 120 may be glued to the bottom 64 side of the cover 60, but a person having ordinary skill in the art would appreciate that other methods and materials for affixing the package opening mechanism 120 to the bottom side 64 of the cover 60 may be compatible with the packaging 10. The package opening mechanism 120 may include a tear strip 126 which is perforated, pre-cut, and/or less robust than the material of the cover 60 to allow a user to remove the tear strip 126. Removal of the tear strip 126 may separate the extension 122, the first side 62, the first sidewall 66, and the second sidewall 68 of the cover 60 from the fastening portion 124 of the package opening mechanism 120 which is affixed to the bottom side 64 of the cover 60. Removal of the tear strip 126 may allow a user to access the container 20 and/or for the body layers 24*a*, 24*b*, 24*c* of the container 20 to expand to the second position.

As illustrated by FIGS. 5-8, expanding the body layers 24*a*, 24*b*, 24*c* of the container 20 to the second position may allow the packaging 10 to be disassembled. Pulling any one of the body layers 24*a*, 24*b*, 24*c* away from the cover 60 may expand the body layers 24*a*, 24*b*, 24*c* from the first position to the second position. The container 20 may separate from the cover 60 by cutting and/or tearing along the fold 12 connecting the bottom outer body layer 24*a* to the bottom side 64 of the cover 60.

Figure 10:
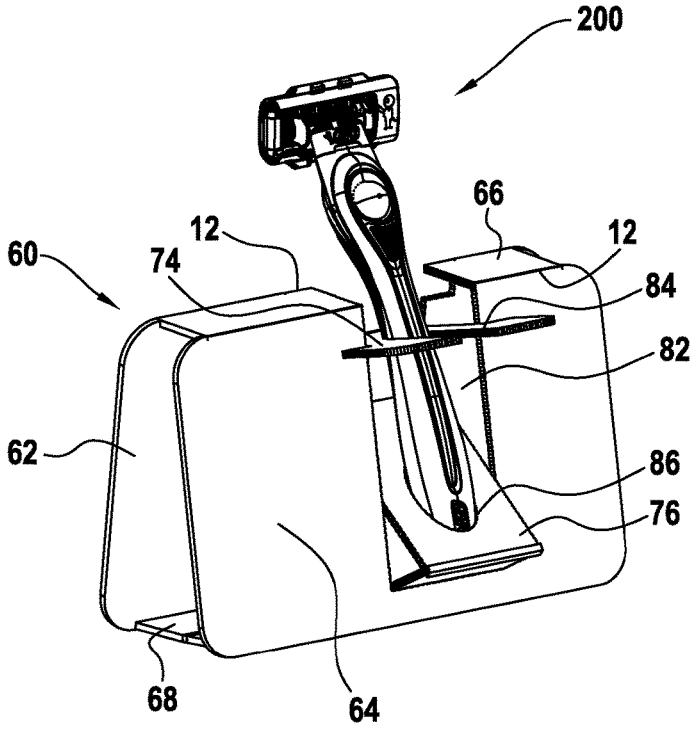
FIG. 10 is a front perspective view of the packaging according to aspects of the disclosure, illustrating a cover of the packaging in a converted state.
Figure 11:
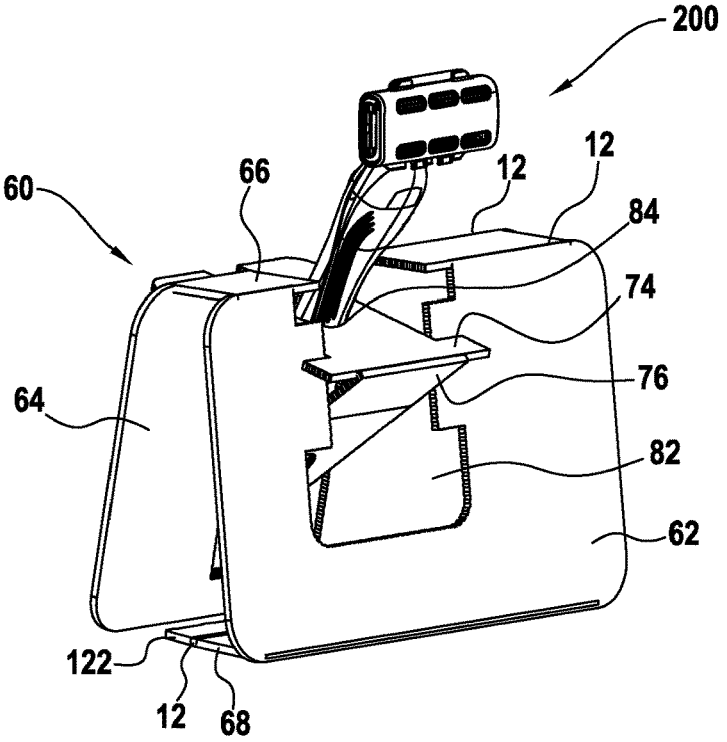
FIG. 11 is a rear perspective view of the packaging of FIG. 10, illustrating the cover of the packaging in the converted state.
Figure 12:
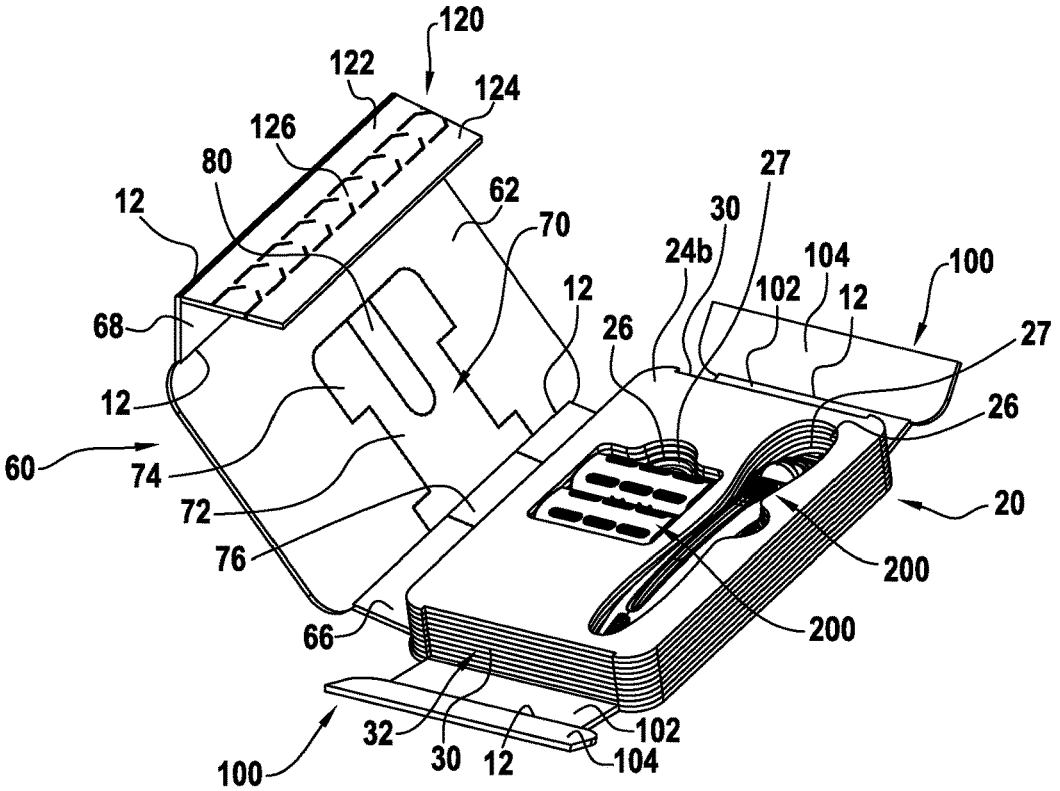
FIG. 12 is a top perspective view of the packaging of FIG. 1, illustrating the container of the packaging in the first position and a product positioned therein.

As shown in FIGS. 1, 5-6, 8, and 10-11 the cover 60 may include a pre-cut section 70 which may be configured to be partially or wholly removed from the cover 60. The term "pre-cut section 70" as referred to herein should be understood to be a section 70 of the cover 60 having a peripheral boundary between the section 70 and the cover 60 which may be pre-cut, perforated, and/or thinner and less robust so that the section 70 may be readily separable from the cover 60. Further, the pre-cut section 70 of the cover 60 may be separated from the remainder of the cover 60, which is not included within the peripheral boundary, by tearing along the pre-cut boundary between the section 70 and the cover 60. After being partially or wholly removed from the cover 60, the pre-cut section 70 may be reinserted into a channel (space) 82 defined by the cover 60 due to removal of the pre-cut section 70. Partially removing the pre-cut section 70 means that a portion of the pre-cut section 70 may comprise e.g. a fold line so that instead of being removed, the pre-cut section 70 remains connected to the top or bottom sides 62, 64 of the cover 60. In this manner, the removed portion of the pre-cut section 70 can be folded about the fold line and reinserted into the channel 82 as described. Reinsertion of the pre-cut section 70 into the channel 82 defined by the cover 60 may support the cover 60 in an upright position to convert the cover 60 into a stand and/or holder for the product 200. The pre-cut section 70 may extend from the top side 62 of the cover 60, through the first sidewall 66, to the bottom side 64 of the cover 60. A person having ordinary skill in the art would understand that conversion of the cover 60 into a stand and/or holder for the product 200 may be a functionality that may exist independent of the container 20. As such, to convert the cover 60 into a holder for the product 200, a user may remove the body layers 24*a*, 24*b*, 24*c* and the extensions, such as the lower and upper sections 102, 104 of the securing extension 100, and the extension 122. The pre-cut section 70 of the top or bottom sides 62, 64 of the cover 60 may take the form of a hook (first segment) 72. In the disclosed embodiment, the hook 72 is in the shape of a double-ended "T" having a pair of arms 74 at each end. There may be further pre-cuts along an inner center portion 80 at an end of the hook 72. The pre-cut section 70 of the bottom or top side 62, 64 of the cover 60 and the first sidewall 66 may take the form of a support (second segment) 76. In the disclosed embodiment, the support 76 is in the shape of an elongated rectangle. There may be further pre-cuts along an ovular or annular inner portion 78 of the support 76. Referring to FIGS. 10-11, removal of the pre-cut section 70 from the cover 60 may define the channel 82 throughout the top side 62, bottom side 64, and first sidewall 66 of the cover 60 in the area previously occupied by the removed pre-cut section 70. The term "removed" as used herein should be understood to mean that an element is detached and/or delimited, wholly or partially, from an element in which it was previously a part of. The top and bottom sides 62, 64 of the cover 60 may be folded toward each other such that each of the top and bottom sides 62, 64 face each other. The hook 72 may then be positioned to extend through the channel 82 so that each pair of arms 74 anchor against exterior surfaces of the first and second sides 62, 64 of the cover 60 to function as a brace for the cover 60. The support 76 may extend from an end of the hook 72 to a surface below to support the hook 72 within the channel 82. The pre-cut center portion 80 at the end of the hook 72 and the pre-cut ovular inner portion 78 may be removed to define a slot 84 and an opening 86, respectively, for holding the product 200 in an upright position. The second sidewall 68 may be folded inwardly from the top side 62 of the cover 60 to lie against a surface, such as a table, to support the cover 60 in an upright position.

The packaging 10 may include a near-field communication (NFC) chip (not shown) embedded in or attached to the cover 60, container 20, securing extensions 100, or package opening mechanism 120 to enable communication with an electronic device exterior to the packaging 10.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

Additionally, all of the disclosed features of an apparatus may be transposed, alone or in combination, to a method and vice versa.

The invention claimed is:

1. A packaging for a product comprising:

a container including a first body layer and a second body layer connected at a fold, the first and second body layers being capable of collapsing to a first position and expanding to a second position, wherein one or more of the first and second body layers defining a void; the packaging further comprising a cover including a first side and a second side, the first and second body layers being configured to collapse to the first position between the first and second sides of the cover, wherein the cover includes a sidewall and the first and second sides are connected to the sidewall at respective folds, and wherein the container and the cover are constructed as one sheet, wherein the cover includes one or more extensions capable of mating with one or more of the body layers.

2. The packaging of claim 1, wherein the cover includes a package opening mechanism.

3. The packaging of claim 2 wherein the package opening mechanism includes a tear strip which is perforated, pre-cut, and/or less robust than a material of the cover, the tear strip being configured to be removed.

4. The packaging of claim 1, wherein each of the body layers comprise a void having a contour and together the voids form a cavity in the first position.

5. The packaging of claim 4, wherein two or more of the contours have different dimensions.

6. The packaging of claim 1, wherein the second side of the cover is connected to one of the body layers at a fold.

7. The packaging of claim 1, wherein the extension includes a first section connecting to the second side of the cover at a fold and a second section connecting to the first section of the extension at a fold.

8. The packaging of claim 7, wherein the first section of the extension is configured to be received by a recess defined by the body layers in a press-fit arrangement.

9. The packaging of claim 7, wherein the second section of the extension is configured to fold over and lay against the second body layer in a surface-to-surface arrangement of the first and second body layers.

10. The packaging of claim 1, wherein the cover includes a second sidewall configured to fold over an outer body layer connecting the second sidewall to the cover and lay against edges of the body layers.

11. The packaging of claim 1, wherein the cover faces the body layers when the body layers are in the first position.

12. The packaging of claim 1, wherein the body layers are configured in a stacked arrangement in the first position.

13. The packaging of claim 1, wherein the cover includes a pre-cut section configured to be removed, removal of the pre-cut section defines a channel in the cover, and reinsertion of the pre-cut section into the channel supports the cover in an upright position.

14. The packaging of claim 1 including a handheld shaving device.

15. A method of making a holder for a product out of the packaging according to claim 1, the method comprising:

providing the packaging having the first side, the second side, and a pre-cut section extending through the first side and the second sides;

removing the pre-cut section from the packaging to define a channel;

folding the first side toward the second side; and reinserting the pre-cut section into the channel to support the packaging in an upright position.

16. The method of claim 15, further comprising removing the body layers and extensions of the cover prior to folding the first side toward the second side.

17. The method of claim 15, wherein the pre-cut section has a hook configured to extend through the channel defined when the pre-cut section is removed and reinserted, the hook also being configured to anchor against exterior surfaces of the first and second sides and a support extending from the hook configured to support the hook within the channel.

18. The method of claim 15, wherein the pre-cut section has further pre-cuts along one or more inner portions configured to be removed to receive the product when the pre-cut is removed and before the pre-cut is reinserted.

19. A packaging for a product comprising:

a container including a first body layer and a second body layer connected at a fold, the first and second body layers being capable of collapsing to a first position and expanding to a second position, wherein one or more of the first and second body layers defining a void; the packaging further comprising a cover including a first side and a second side, the first and second body layers being configured to collapse to the first position between the first and second sides of the cover, wherein the cover includes a sidewall and the first and second sides are connected to the sidewall at respective folds, and wherein the container and the cover are constructed as one sheet, wherein the cover includes a pre-cut section configured to be removed, removal of the pre-cut section defines a channel in the cover, and reinsertion of the pre-cut section into the channel supports the cover in an upright position.

* * * * *